US006930648B2

(12) United States Patent
Ashoor

(10) Patent No.: US 6,930,648 B2
(45) Date of Patent: Aug. 16, 2005

(54) SATELLITE RECEIVER

(75) Inventor: Fayek Ashoor, Skarholmen (SE)

(73) Assignee: Horizon Microwaves Ltd., Walthamstow (GB)

( * ) Notice: Subject to any disclaimer, the term of this patent is extended or adjusted under 35 U.S.C. 154(b) by 0 days.

(21) Appl. No.: 10/220,259

(22) PCT Filed: Dec. 27, 2000

(86) PCT No.: PCT/SE00/02681

§ 371 (c)(1),
(2), (4) Date: Oct. 23, 2002

(87) PCT Pub. No.: WO01/65639

PCT Pub. Date: Sep. 7, 2001

(65) Prior Publication Data

US 2003/0142030 A1 Jul. 31, 2003

(30) Foreign Application Priority Data

Mar. 3, 2000 (SE) ..... 0000712

(51) Int. Cl.[7] ..... H01Q 13/00
(52) U.S. Cl. ..... 343/775; 343/781 R; 343/786

(58) Field of Search ..... 343/772, 775, 343/776, 781 R, 782, 786, 840

(56) References Cited

U.S. PATENT DOCUMENTS 6,111,547 A * 8/2000 Gau et al. ..... 343/786
6,121,939 A * 9/2000 Imaizumi et al. ..... 343/840

FOREIGN PATENT DOCUMENTS

| | | |
|---|---|---|
| EP | 0843381 A2 | 5/1998 |
| WO | 9602953 A1 | 2/1996 |
| WO | 9954958 A1 | 10/1999 |

* cited by examiner

*Primary Examiner*—Shih-Chao Chen
(74) *Attorney, Agent, or Firm*—Nixon & Vanderhye P.C.

(57) ABSTRACT

In a satellite receiver a feeder element is provided that includes several feeder horns on a microwave head (low noise block downconverter (LNB)) for distributing satellite signals from different satellites to different channels in the different horns and means for blocking all channels, except for the one that is presently desired to be used, before the signals sent on these channels reach the microwave head.

20 Claims, 3 Drawing Sheets

SATELLITE RECEIVER

This application is the US national phase of international application PCT/SE01/02681 filed 27 Dec. 2000, which designated the US.

TECHNICAL FIELD

The present invention relates to a satellite receiver, and particularly a satellite receiver arranged to receive signals from several different satellites.

STATE OF THE ART

Equipment for receiving TV-channels (signals), which are sent out from several different satellites, today consists of a parabolic antenna of varying size and several side mounted microwave heads which are directed towards the middle of the parabolic antenna and, via a switch, can be selected to show TV-channels from different satellite directions.

Thus, today's satellite receiver requires a microwave head for each satellite from which the parabolic antenna is arranged to receive signals. Of course, this is expensive.

Furthermore it is not possible to reach adjacent satellites with this conventional side mounting. The reason is that the physical space required by each microwave head makes it physically impossible to locate these so close to each other as would be required for e.g. receiving signals from satellites located at, for example, a distance of 3 degrees from each other, which is a normal distance between two satellites.

To be able to receive mutually adjacent signals in today's satellite receiver system, motor operation of the parabolic antenna is required Such a motor operation is both expensive and difficult to set up. As always when movable parts are required, there is a great risk that an error will appear and that expensive repair costs will arise.

The Swedish patent application 8802441-9, the American patents U.S. Pat. No. 5,276,904 and U.S. Pat. No. 5,283,591 and the international patent application WO 99/54958 all describe conventional satellite receivers for receiving signals from several different satellites. An example of the appearance of such a conventional receiver equipment is illustrated in FIG. 1. The equipment includes i.a. a parabolic antenna 1 and microwave heads 9.

Also, the U.S. Pat. No. 5,812,096 discloses a satellite antenna having a Siamese feedhorn. The use of the Siamese feedhorn enables the receiver to receive signals from satellites being close but still requires a multitude of microwave or LNBs.

DESCRIPTION OF THE INVENTION

There is an object of the present invention to provide a satellite receiver that avoids all the above mentioned disadvantages present in conventional satellite receivers for receiving signals from several satellites.

This object and other ones are attained by means of a satellite receiver provided with a feeder element including at least two feeder horns located on, or in connection with, a microwave head for distributing satellite signals from different satellites on different channels and means for blocking all channels, except for the one that presently is desired, before the signals sent on these channels reach the microwave head (LNB).

Thus there is arranged a feeder element including an optional number of feeder horns, depending on the number of satellites from which a user desires to receive signals. The feeder element is provided with a blocking/opening system. Blocking/opening can be carried through electronically, mechanically, or both in connection, and depending on which horn the user at a certain occasion desires the satellite signal to be received. Controlling blocking/opening is performed via the satellite receiver or similarly.

With the device herein described also signals from adjacent satellites can be received without any special arrangements. The system can furthermore be put together/set up with a conventional microwave head (LNB) and is suitable in parabolic antenna plants existing today, which most often use 40 millimeter holders.

BRIEF DESCRIPTION OF THE DRAWINGS

The present invention will now be described more closely by means of not limiting examples and with reference to the attached drawings, on which.

DESCRIPTION OF PREFERRED EMBODIMENTS

Figure 1:
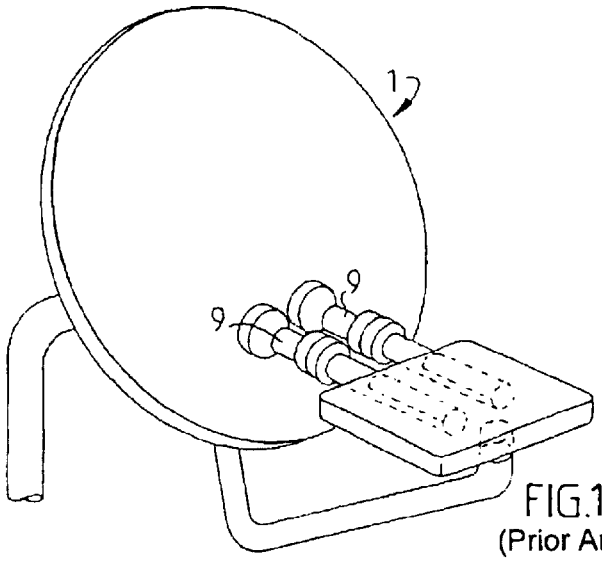
FIG.1 (Prior Art)
FIG. 1 shows a conventional satellite receiver for receiving signals from several satellites.
Figure 2:
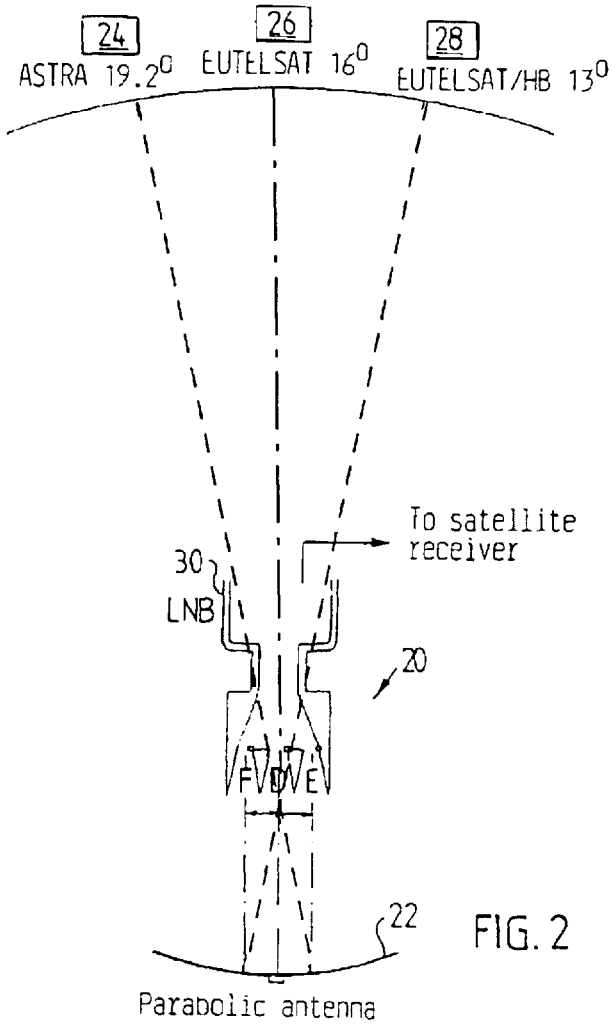
FIG. 2 shows a schematic view of a receiver equipment for receiving satellite signals provided with a feeder element.

FIG. 2 shows a schematic view of a satellite receiver equipment provided with a feeder element 20 arranged on a microwave head (LNB) 30. The microwave head 30 receives signals from different satellites via a parabolic antenna 22. The satellites can e.g. be ASTRA 24, EUTELSAT 26 and EUTELSAT/HB 28.

The signals from the different satellites are received by the parabolic antenna and are directed towards the microwave head 30 provided with the feeder element 20. In the feeder element 20 one of the signals from the different satellites 24, 26 or 28 is selected to be fed to the microwave head. This is described more closely below in connection with FIG. 3. The signal received by the microwave head is then transferred in a conventional manner to a satellite receiver.

Figure 3:
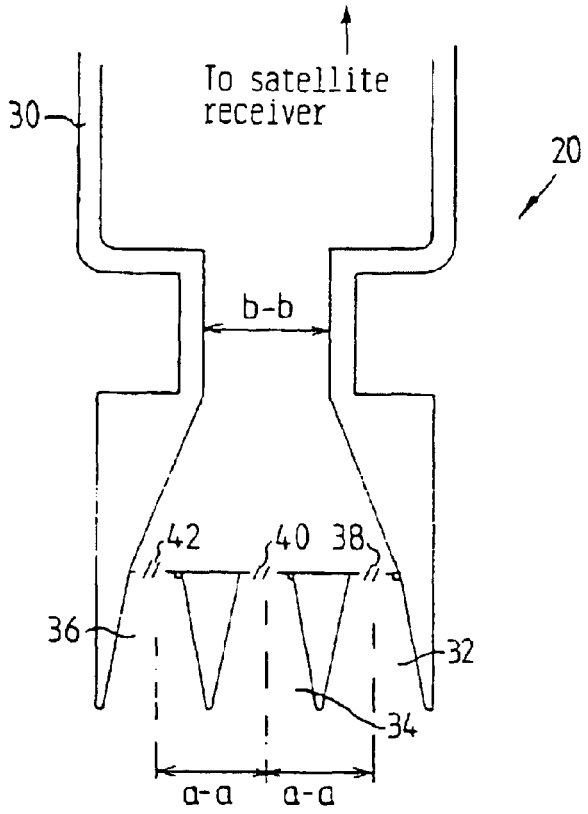
FIG. 3 more closely shows a section through a feeder element shown in FIG. 2.
Figure 3:
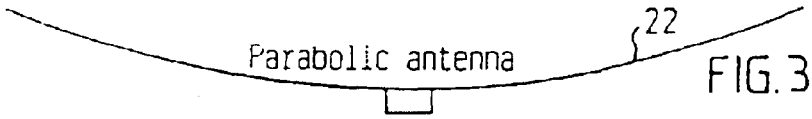

FIG. 3 shows a feeder element 20 in more detail. In the embodiment shown in FIGS. 2–4 the feeder element 20 has three feeder horns 32, 34 and 36. The number of horns can, however, be varied depending upon the number of different satellites from which signals are desired to be received.

Each horn 32, 34 and 36 is furthermore provided with an individual blocking means 38, 40 and 42, respectively, for blocking a signal through the respective horn. The means 38, 40 and 42 can either be mechanical, electrical or electromechanical and are arranged to be controlled individually so as to allow signals from the different satellites to pass through only one horn at a time.

The signal from the satellite 24 is thus conducted through the horn 32, the signal from the satellite 26 through the horn 34 and the signal from the satellite 28 through the horn 36. At reception of the signal from the satellite 24 the horns 34 and 36 are blocked by means of the blocking means 40 and 42. Reception of signals from the satellites 26 and 28 is attained in a corresponding way.

Preferably, the horns 32, 34 and 36 should have such a shape that the distance between an imaginary central line through each horn is 30 millimeters, the distance a—a in FIG. 3. Furthermore the feeder element preferably has a base with an outer diameter of 40 millimeters as a maximum so as to suit conventional microwave heads, the distance b—b in FIG. 3.

Figure 4:
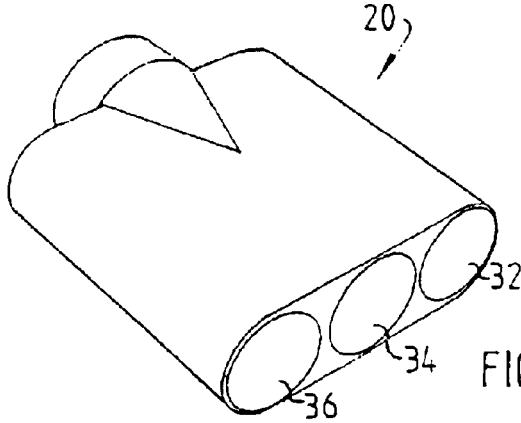
FIG. 4 shows a perspective view of a feeder element with three feeder horns.

FIG. 4 illustrates a perspective view of the feeder element 20 with three feeder horns 32, 34 and 36.

Figure 5:
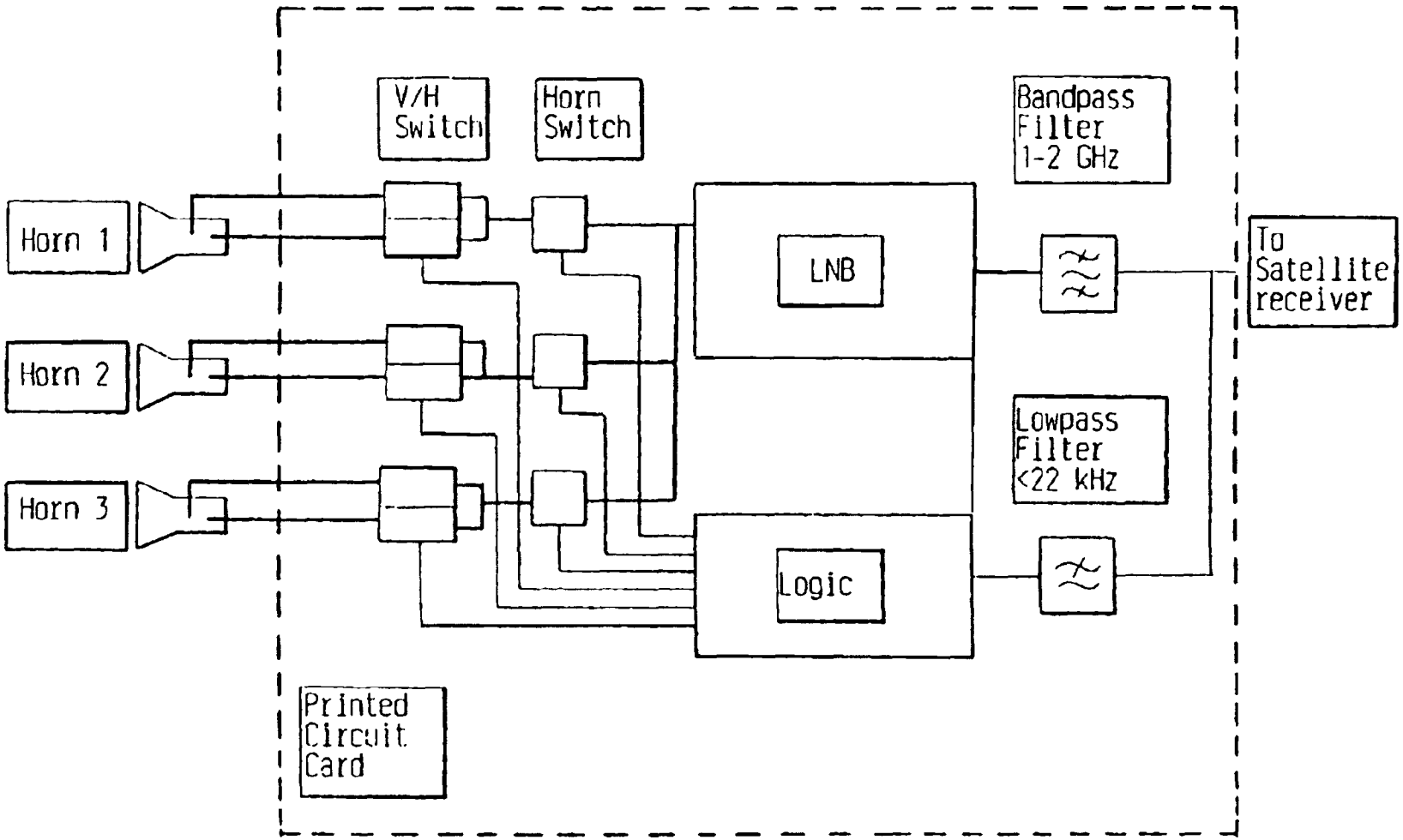
FIG. 5 is a block diagram of a satellite receiver connected to a feeder element shown in FIG. 2.

In FIG. 5 a block diagram of a printed circuit card used to extract the desired signal for the satellite receiver is shown. The printed circuit card comprises an LNB or microwavehead. The circuit card also comprises horn switches for switching between the different horns. The switches are controlled by a logic unit.

By arranging a suitable number of feeder horns, depending on the number of satellites from which the user desires to receive signals, the problems of the prior art are avoided. The separation/spacing of the satellites is irrelevant in this context.

By the device described here also signals from adjacent satellites can be received without any special arrangements, such as motor operation, or similar, of the receiver equipment.

The system can furthermore be put together/assembled with a conventional microwave head (LNB), and therefore a receiver system according to that described here provides a cost-effective way of receiving signals from different satellites.

What is claimed is:

1. A receiver for receiving satellite signals comprising:

a microwave head (low noise block downconverter (LNB)), a parabolic antenna, and a feeder element arranged between the microwave head and the parabolic antenna, the feeder element comprising:

at least two feeder horns, and a base positioned between the feeder horns an the microwave head, the at least two feeder horns guiding satellite signals propagating through the at least two feeder horns into the base to be directed to and received by the microwave head.

2. The receiver of claim 1, further comprising means for blocking at least one feeder horn.

3. The receiver of claim 2, wherein said blocking means includes means for blocking all horns except for the one conducting the signal of the satellite from which a signal is desired to be received.

4. The receiver of claim 1, further comprising a blocking system for blocking said satellite signals from propagating through at least one of said at least two feeder horns.

5. The receiver of claim 4, wherein said blocking system includes individually controllable horn switches arranged in said feeder horns, each feeder horn having an own, individual horn switch capable of blocking satellite signals from propagating through said feeder horn.

6. The receiver of claim 4, wherein said blocking system is arranged to block said satellite signals from propagating through all of said at least two feeder horns except that one of the at least two feeder horns through which satellite signals are guided from a satellite from which a signal is desired to be received.

7. The receiver of claim 6, wherein said blocking system is electronic.

8. The receiver of claim 1, further comprising a logic unit connected to said horn switches for controlling them.

9. The receiver of claim 1, wherein the distance from a central line through a first feeder horn to that of an adjacent second feeder horn of said at least two feeder horns is 30 millimeters.

10. The receiver of claim 1, wherein the outer diameter of the base of the feeder element is 40 millimeters as a maximum.

11. A feeder element for guiding satellite signals reflected by a parabolic antenna to a microwave head (low noise block downconverter (LNB)), the feeder element including at least two feeder horns and a base positioned between the feeder horns and the microwave head, the at least two feeder horns guiding said satellite signals propagating through the at least two feeder horns into the base to be directed to and received by the microwave head.

12. The feeder element according to claim 11, further comprising a blocking system arranged to block said satellite signals from propagating through at least one of said at least two feeder horns.

13. The feeder element according to claim 12, wherein the blocking system is electronic.

14. The feeder element of claim 12, wherein said blocking system includes individually controllable horn switches arranged in said feeder horns, each feeder horn having an own, individual horn switch capable of blocking satellite signals from propagating through said feeder horn.

15. The feeder element of claim 12, further comprising a logic unit connected to said horn switches for controlling them.

16. The feeder element of claim 12, wherein said blocking system is arranged to block said satellite signals from propagating through all of said at least two feeder horns except one, said one being a feeder horn through which satellite signals are guided from a satellite from which a signal is desired to be received.

17. The feeder element according to claim 11, wherein the distance from a central line through a first feeder horn to that of an adjacent second feeder horn of said at least two feeder horns is 30 millimeters.

18. The feeder element according to claim 11, wherein the outer diameter of the base of the feeder element is 40 millimeters as a maximum.

19. A feeder element for guiding satellite signals reflected by a parabolic antenna to a low noise block converter, the feeder element including at least two feeder horns and a base positioned between the feeder horns and the microwave head, the at least two feeder horns guiding said satellite signals propagating through the at least two feeder horns into the base to be directed to and received by the converter.

20. A receiver for receiving satellite signal comprising:

a low noise block converter, a parabolic antenna, and a feeder element arranged between the converter and the parabolic antenna, the feeder element including at least two feeder horns and a base positioned between the feeder horns and the microwave head, the at least two feeder horns guiding satellite signals propagating through the at least two feeder horns into the base to be directed to and received by the converter.

* * * * *